US008126822B1

(12) United States Patent
Sansone et al.

(10) Patent No.: US 8,126,822 B1
(45) **Date of Patent: *Feb. 28, 2012**

(54) VIRTUAL POST OFFICE BOX

(75) Inventors: Ronald P. Sansone, Weston, CT (US); Fran E. Blackman, Weston, CT (US); Daniel F. Dlugos, Huntington, CT (US); Leon A. Pintsov, West Hartford, CT (US); Denis J. Stemmle, Milford, CT (US); Francis X. Hines, Jr., Lynnfield, MA (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/316,795

(22) Filed: May 21, 1999

(51) Int. Cl.
*G06Q 30/00* (2006.01)

(52) U.S. Cl. ..... 705/401; 705/402; 705/406; 705/408; 705/410

(58) Field of Classification Search ..... 705/401, 705/402, 406, 408, 410
See application file for complete search history.

(56) References Cited

U.S. PATENT DOCUMENTS

| | | | | |
|---|---|---|---|---|
| 4,831,555 A | | 5/1989 | Sansone et al. | 358/1.14 |
| 5,420,403 A | | 5/1995 | Allum et al. | 235/375 |
| 5,422,821 A | * | 6/1995 | Allen et al. | 700/219 |
| 5,452,203 A | * | 9/1995 | Moore | 707/200 |
| 5,805,810 A | | 9/1998 | Maxwell | 395/200.36 |
| 6,005,945 A | * | 12/1999 | Whitehouse | 380/51 |
| 6,006,200 A | * | 12/1999 | Boies et al. | 705/26 |
| 6,549,892 B1 | * | 4/2003 | Sansone | 705/401 |

FOREIGN PATENT DOCUMENTS

JP 09-57199 3/1997

OTHER PUBLICATIONS

"Siemens Wins US Post Office Contract" Oct. 7, 1998 p. 1, European Report Brussels.*

* cited by examiner

*Primary Examiner* — Nga B. Nguyen
(74) *Attorney, Agent, or Firm* — Steven J. Shapiro; Charles R. Malandra, Jr.

(57) ABSTRACT

A method that enables the post to deliver letters, flats, post cards and packages (mail) addressed to a recipient's virtual post office box and then to be delivered directly to the recipient. The process enables individuals or entities to rent a virtual post office (VPO) box i.e., a box that does not physically exist, from the post office ("post"). Mail addressed to the virtual post office box would be captured by the post during the post's sortation process and rerouted to the specified address of the renter of the virtual post office box.

18 Claims, 11 Drawing Sheets

VIRTUAL POST OFFICE BOX

CROSS REFERENCE TO RELATED APPLICATIONS

Reference is made to commonly assigned copending patent application Ser. No. 09/316,403 filed herewith entitled "A System For Delivering Mail" in the name of Ronald P. Sansone.

FIELD OF THE INVENTION

The invention relates generally to the field of mail delivery systems and more particularly to systems for delivering mail from virtual post office boxes to recipients.

BACKGROUND OF THE INVENTION

From the dawn of civilization people have directly transmitted information from one person to another. Information was first transmitted by speech and later by the written word. Writings enabled people to transmit information by messengers from a location in which the sender of the writing was present to another location where the receiver was present. In time, postal services were developed in which a person would deliver a letter to the post office (hereinafter "post") in one city and an agent of the post office would deliver that letter to a post office in another city, where the letter would be picked up by the person to whom the letter was sent.

Ever since the numeric codification of streets and buildings received general acceptance, an individuals' name and their household postal addresses have been linked. The sender of a letter or package would deliver a letter or package to the post office, that had the correct recipient postal address and the post office would deliver the letter or package to the numeric street address of the recipient of the letter or package. A correct recipient postal address for the delivery of the letter or package to the recipient included: the name of the recipient; the street address of the recipient; the city and state of the recipient; and the zip code of the recipient. Thus, the correct recipient postal address is usually the actual location of the recipient.

The post office also delivers letters and packages to post office boxes. A post office box is a locked receptacle, located at a specific post office, where the box has been assigned to a specific recipient so that correctly addressed letters and packages may be delivered to the box by the post office and be removed by the recipient. A correct recipient post office box address for the delivery of the letter or package to the recipient's post office box included: the name of the recipient; the number of the post office box of the recipient's; the city and state where the recipient post office box is located; and the zip code of the post office where the recipient's post office box is located.

One of the reasons why recipients of letters and packages rent post office boxes is that the recipient did not want the sender of the letter or package to know the actual location of the recipient. The above reason for having post office boxes has increased dramatically in the past few years because many people are conducting business out of their homes and they do not want certain senders of letters and packages to know the location of their homes. Thus, there has been a tremendous increase in the use of post office boxes. Consequently, the post at certain post offices is experiencing a shortage of post office boxes.

A disadvantage of the prior art is that renters of post office boxes have to go to the post office where the post office box is located to receive their letters and packages. Thus, the owners of business run out of the home and others are expending additional time to retrieve their letters and packages.

Another disadvantage of the prior art is that if renters of post office boxes do not remove their letters and packages before the post office box is full, the post has to specially handle the excess letters and packages.

A further disadvantage of the prior art is that post office boxes consume a large amount of space at post offices.

A additional disadvantage of the prior art is that when the renter of a post office box goes to a different location, i.e., on vacation there is no mechanism for redirecting the letters and packages located in the post office box to the different location.

SUMMARY OF THE INVENTION

This invention overcomes the disadvantages of the prior art by providing a method that enables the post to deliver letters, flats, post cards and packages (mail) addressed to a recipient virtual post office box to be delivered directly to the recipient. The invention enables individuals or entities to rent a virtual post office (VPO) box i.e., a box that does not physically exist, from the post. Mail addressed to the virtual post office box would be captured by the post during the post's sortation process and rerouted to the specified address of the renter of the virtual post office box.

An advantage of this invention is that a renter of a virtual post office box may receive mail at their specified location while this location will not be known to parties who send mail to the virtual post office box.

An additional advantage of this invention is that mail can be easily redirected from one specified location to another specified location.

A further advantage of this invention is that virtual post office boxes do not take up any space and an unlimited number of boxes may be issued.

DETAILED DESCRIPTION OF THE PREFERRED EMBODIMENT

Figure 1:
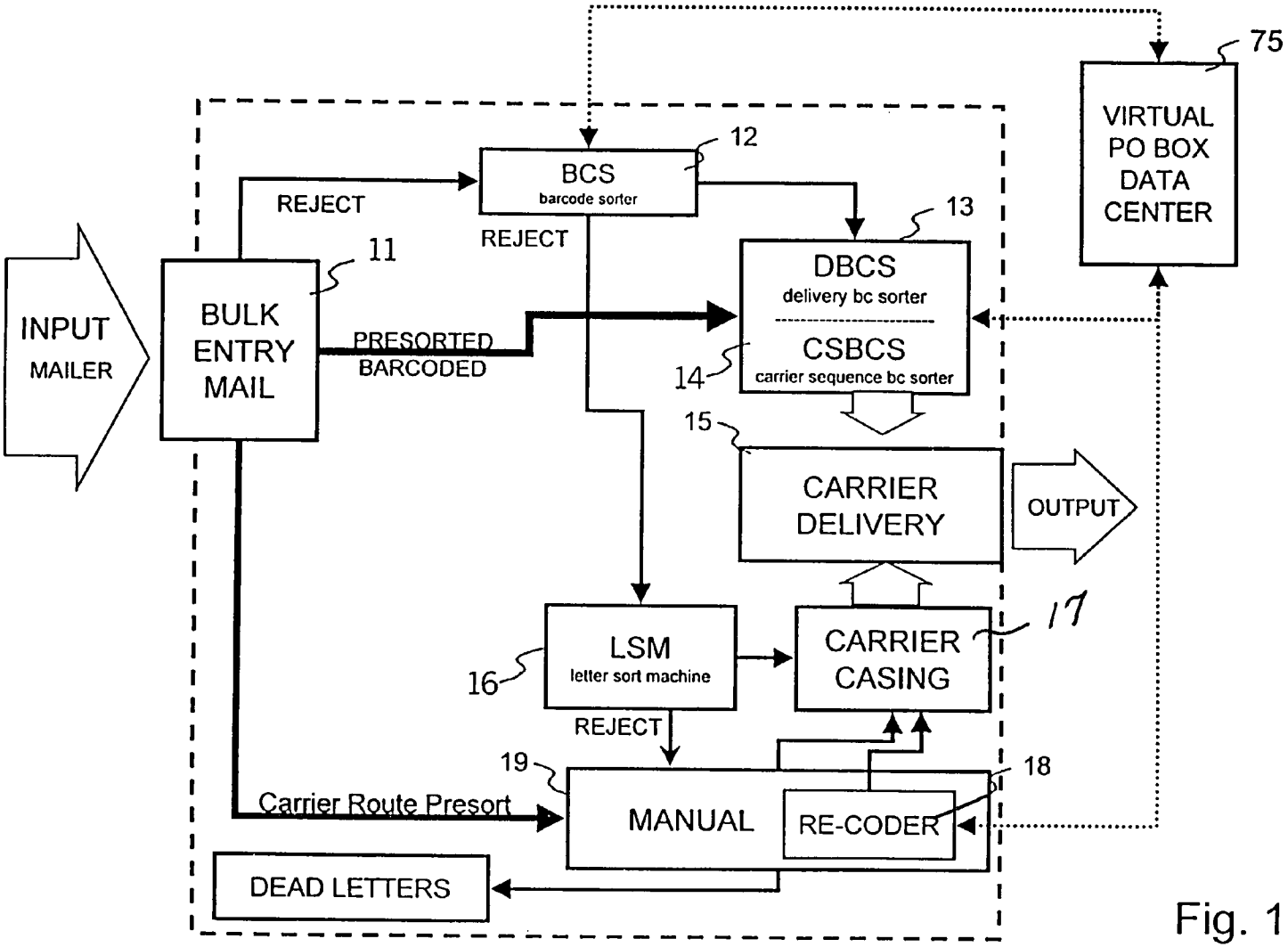
FIG. 1 is a drawing showing how this invention may be used in the processing of bulk entry mail.

Referring now to the drawings in detail and more particularly to FIG. 1, the reference character 11 represents the entry of bulk entry mail to the post. The post receives and processes bulk entry mail and collection mail. Collection mail will be described in the description of FIG. 2. Approximately 60 percent of the mail currently received by the United States Postal Service is bulk entry mail. Bulk entry mail is mail received by the post that is trayed, presorted, metered, bearing a permit or pre-cancelled stamp. Bulk entry mail that has been bar coded but not sorted correctly by the mailer will be scanned and sorted by bar code sorter/code printer 12. Mail that is able to be scanned and sorted by sorter 12 is sent to a delivery bar code sorter/code printer 13 or a carrier sequence bar code sorter 14. Sorter 13 sorts mail that is going to be delivered to other postal facilities. Sorter 14 sort the mail in the order that the mail is going to be delivered by postal carrier 15.

Mail that can not be scanned and sorted by sorter 12 is sent to letter sort machine 16. Letter sort machine 16 is a manually operated machine in which the operator enters a zip code for the mail. Machine 16 is a mechanical sorter that sorts the mail in accordance with the zip code entered by the operator of machine 16. Mail that can be sorted by letter sort machine 16 is sent to carrier casing 17. Carrier casing 17 is the process in which the postal carrier sorts the mail in the order that the mail is going to be delivered by postal carrier 15. Mail that can not be sorted by letter sort machine 16 is sent to manual process 19. Manual process 19 attempts to classify the previously rejected mail piece to: redirect the mail piece; declare the mail piece dead; or manually re-code the mail piece for redelivery. Then the mail pieces that have not been processed in manual process 19 are re-coded in process 18. In re-coder process 18 an operator may look up the VPO in virtual post office box data center 75 and produce a label to be placed on the mail piece. Bulk entry mail that has been presorted in accordance with the postal carrier route is sent in trays to manual process 19. Then the mail would go to carrier casing where the mail is sorted in the order that the mail is going to be delivered by postal carrier 15.

Figure 4:
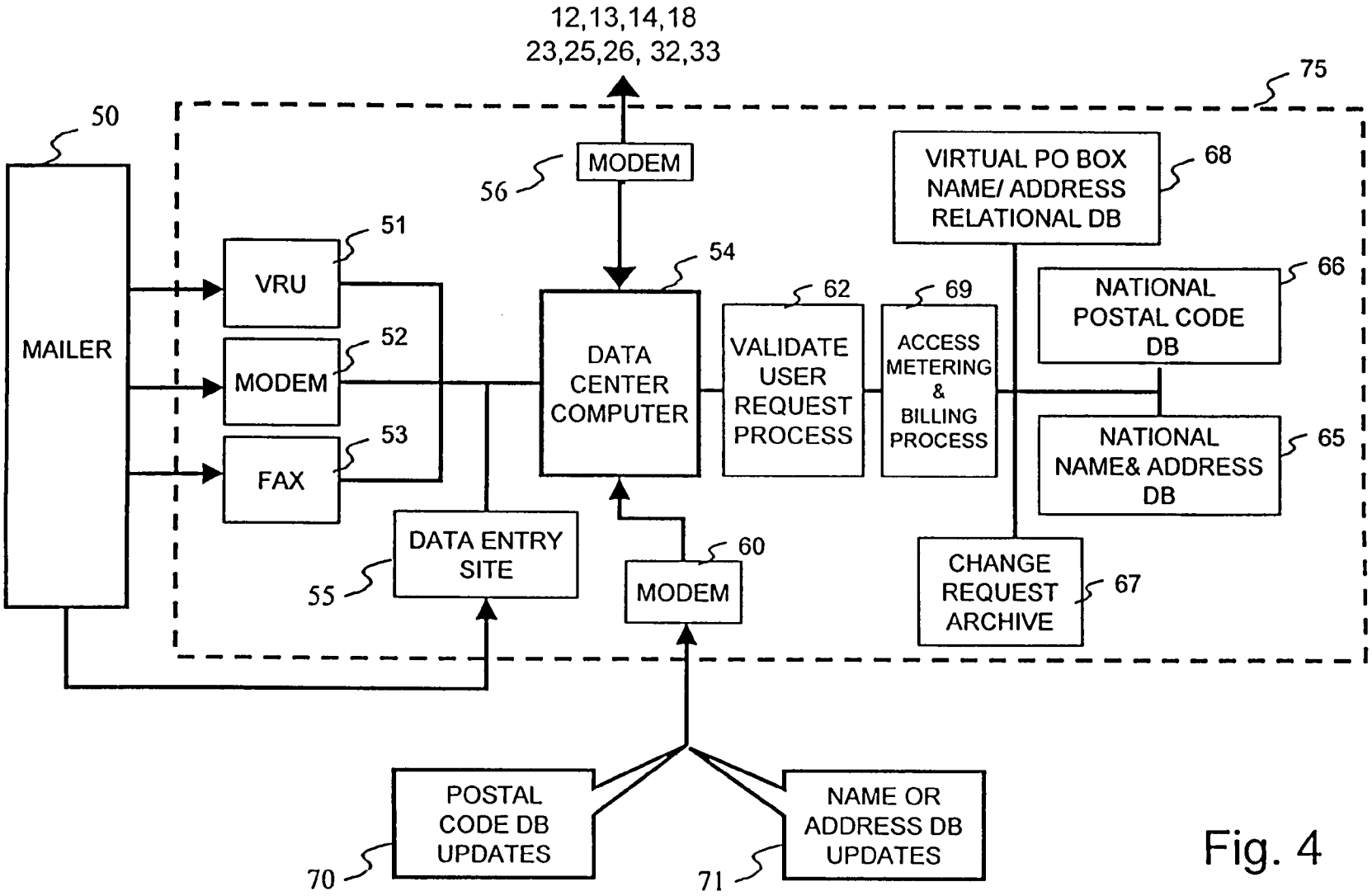
FIG. 4 is a drawing showing how one may obtain a virtual post office box and how one may change the address to which the mail having a virtual post office box will be delivered.

Mail that has been scanned by bar code sorter 12 and mail that has been scanned by scanners 13 and 14 will be checked by virtual post office box data center 75, if scanners 12, 13 or 14 detect a virtual post office box in the recipient address field of the mail, i.e., VPO Box 182945AA or scan a virtual post office box in the bar code affixed to the mail by the mailer. Virtual post office box data center 75 contains a virtual post office name/address relational database 68 (FIG. 4). Database 68 will use the virtual post office box number to determine the actual destination that the recipient wants the mail delivered to. The foregoing may be accomplished by looking up the virtual post office box in database 68 and determining the address that the owner of the virtual post office box wanted their mail forwarded. Database 68 supplies information to sorters 12, 13 and 14 and re-coder 18 via computer 54 so that sorters 12, 13 and 14 and re-coder 18 will place a bar code on the mail that indicates the zip code that the owner of the virtual post office box wants their mail forwarded. Sorters 12, 13 and 14 and re-coder 18 will also print the street, city and state that the owner of the virtual post office box wants their mail forwarded in human readable form.

Figure 2:
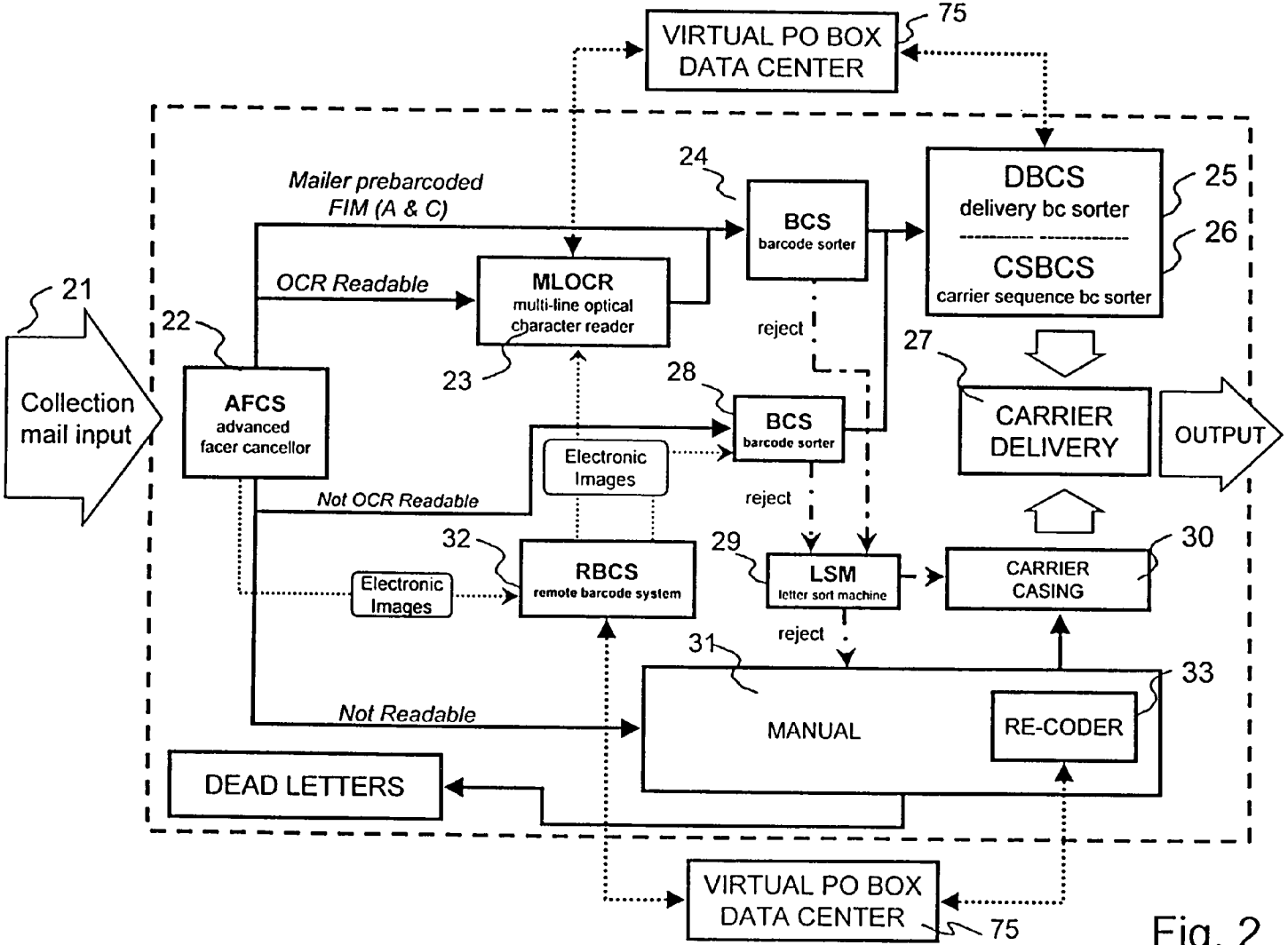
FIG. 2 is a drawing showing how this invention may be used in the processing of collection mail.

FIG. 2 is a drawing showing how this invention may be used by the post in the processing of collection mail 21. Approximately 40 percent of the mail currently received by the United States Postal Service is collection mail. Collection mail is metered, stamped or business reply permit mail that is placed in mail boxes or delivered to the United States Postal Service unsorted. Collection mail is sent to advanced facer canceller 22. Facer canceller 22 first faces the mail. Then facer canceller 22 electronically identifies and separates pre-barcoded mail, handwritten addresses and machine-imprinted address pieces for faster processing through automation. Mail that canceller 22 determines is optical character readable is sent to multi-line optical character reader/code printer 23. Reader 23: reads the entire address on the mail: sprays a bar code on the mail; and then sorts the mail. Mail that is able to be scanned and sorted by reader 23 is sent to bar code sorter/code printer 24. Mail that the mailer has prebar-coded and contains a facing identification mark is sent to bar code sorter/code printer 24.

Mail that is able to be scanned and sorted by sorter 24 is sent to a delivery bar code sorter/code printer 25 or a carrier sequence bar code sorter/code printer 26. Sorters 25 and 26 sort the mail in the order that the mail is going to be delivered by postal carrier 27. Mail that canceller 22 determines is not optical character readable is sent to bar code sorter/code printer 28. Mail that canceller 22 obtains electronic images from and mail that reader 23 obtains electronic images from transfers the electronic images to remote bar code system 32. Bar code system 32 matches the look up zip code for the mail pieces from canceller 22 and merges them. System 32 electronically transmits the bar code information to sorter 28 where the bar code information is sprayed on the mail pieces. Mail that is able to be scanned and sorted by sorters 24 and 28 is sent to a delivery bar code sorter 25. Sorters 25 and 26 sort the mail in the order that the mail is going to be delivered by postal carrier 27.

Mail that can not be scanned and sorted by sorters 24 and 28 is sent to letter sort machine 29. Mail that can be sorted by letter sort machine 29 is sent to carrier casing 30. Carrier casing 30 is the process in which the postal carrier sorts the mail in the order that the mail is going to be delivered by postal carrier 27. Mail that can not be sorted by letter sort machine 29 is sent to manual process 31. Manual process 31 attempts to classify the previously rejected mail piece to: redirect the mail piece; declare the mail piece dead; or manually re-code the mail piece for redelivery. Then the mail pieces that have not been processed in manual process 31 are re-coded in process 33. In re-coder process 33, an operator may look up the VPO box in virtual PO Box data center 75 and produce a label to be placed on the mail piece. Then the mail would go to carrier casing 30 where the mail is sorted in the order that the mail is going to be delivered by postal carrier 27.

Mail that can not be faced and cancelled by canceller 22 is sent to manual process 31. Manual process 31 attempts to classify the previously rejected mail piece to: redirect the mail piece; declare the mail piece dead; or manually re-code the mail piece for redelivery. Then the mail that manual process 31 is able to classify is sent to carrier casing 30 before it is delivered by carrier 27. Mail that can not be classified by process 31 is sent to recoder 33. Recoder 33 will look up the VPO address in virtual PO Box data center 75.

Mail that has been read by reader 23 and mail that has been coded by system 32 or by re-coder 33 will be checked in virtual Post Office Box data center 75, if a virtual post office box appears in the recipient address field of the mail or in the bar code affixed to the mail, i.e., VPO Box 182945AA or scan a virtual post office box in the bar code affixed to the mail by the mailer. Virtual post office box data center 75 contains a virtual post office name/address relational database 68 (FIG. 4). Database 68 will use the virtual post office box number to determine the actual destination that the recipient wants the mail delivered to. The foregoing may be accomplished by looking up the virtual post office box in database 68 and determining the address that the owner of the virtual post office box wanted their mail forwarded. Database 68 supplies information to reader 23, sorters 24, 25, 26 and 28 and re-coder 33 so that sorters 24, 25, 26 and 28 and re-coder 33 will place a bar code on the mail that indicates the zip code that the owner of the virtual post office box wants their mail forwarded. Sorters 24, 25, 26 and 28 and re-coder 33 will also print the street, city and state that the owner of the virtual post office box wants their mail forwarded in human readable form.

Figure 3A:
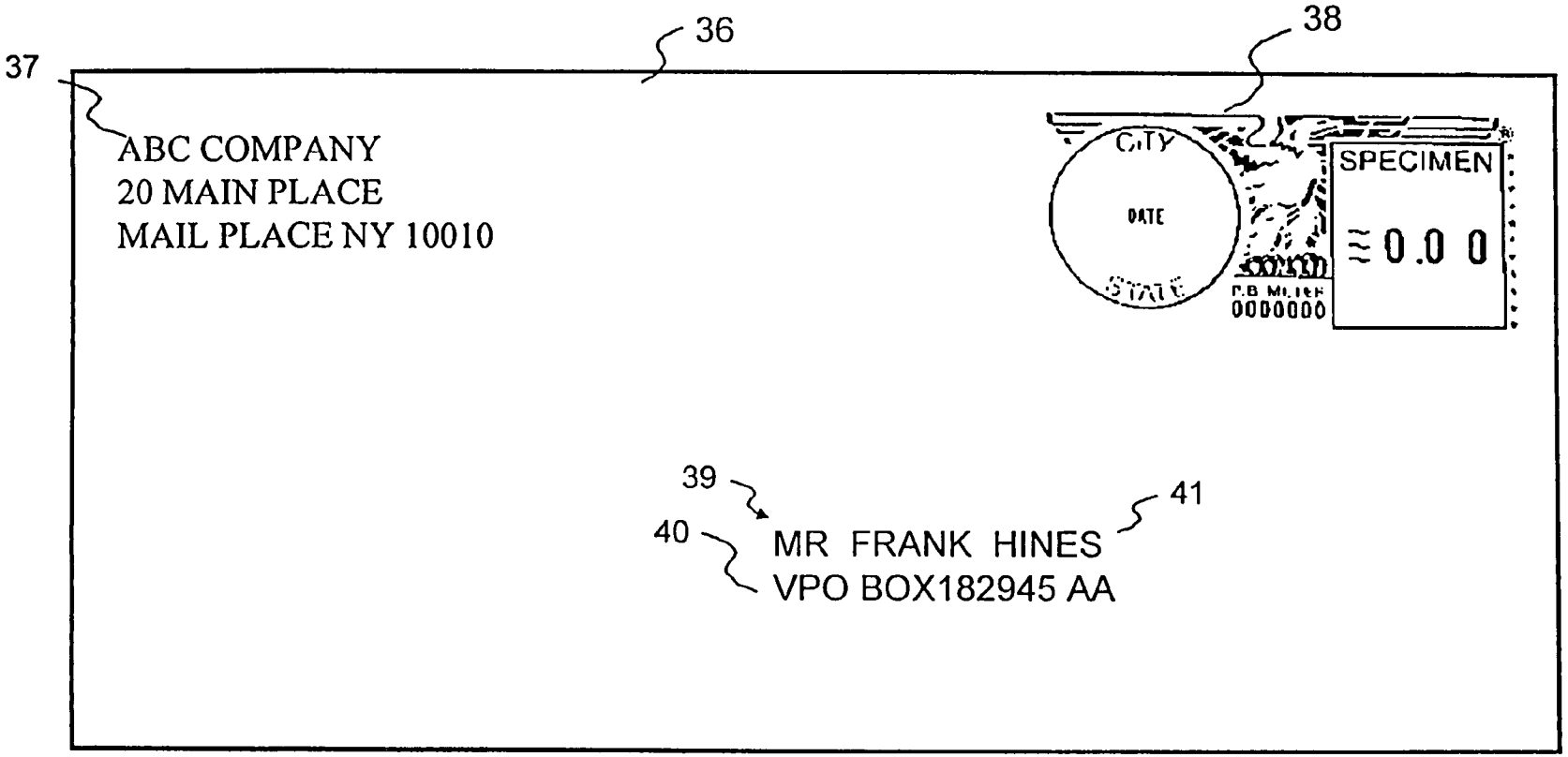
FIG. 3A is a drawing of a mail piece addressed to a virtual post office (VPO) box.

FIG. 3A is a drawing of a mail piece addressed to a virtual post office (VPO) box. Mail piece 36 has a sender address field 37 and material 38 that indicates the payment of the postage for mail piece 36. Material 38 may be a postal indicia, postal permit or one or more stamps. The recipient address field 39 will only have to include the designation 40 for a virtual post office box and the box number i.e., VPO etc. and the number of the virtual post office box and the person or entity 41 to whom mail piece 36 is sent.

Figure 3B:
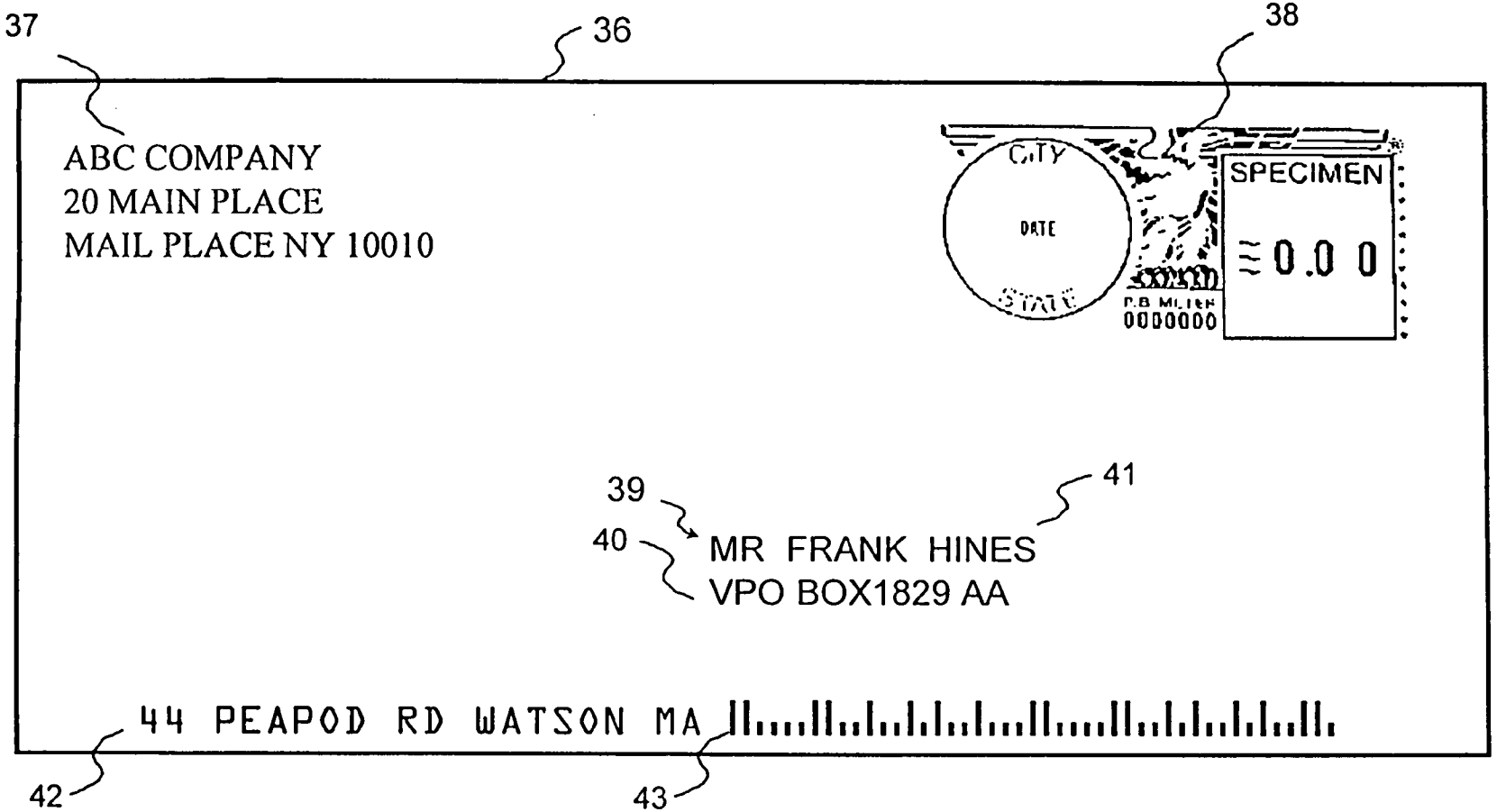
FIG. 3B is a drawing of a mail piece addressed to a virtual post office (VPO) box which the post has indicated the actual delivery address.

FIG. 3B is a drawing of a mail piece addressed to a virtual post office (VPO) box which the post has indicated the actual delivery address. Mail piece 36 has a sender address field 37 and material 38 that indicates the payment of the postage for mail piece 36. Material 38 may be a postal indicia, postal permit or one or more stamps. The recipient address field 39 will include the designation 40 for a virtual post office box and the box number i.e., VPO etc. and the number of the virtual post office box and the person or entity 41 to whom mail piece 36 is sent. The post will print the actual delivery address 42 that the lessee of the virtual post office box wants mail piece 36 delivered to. The post will also print a postnet bar code 43 on the face of mail piece 36. Bar code 43 represents delivery address 42 in a coded form.

Figure 3C:
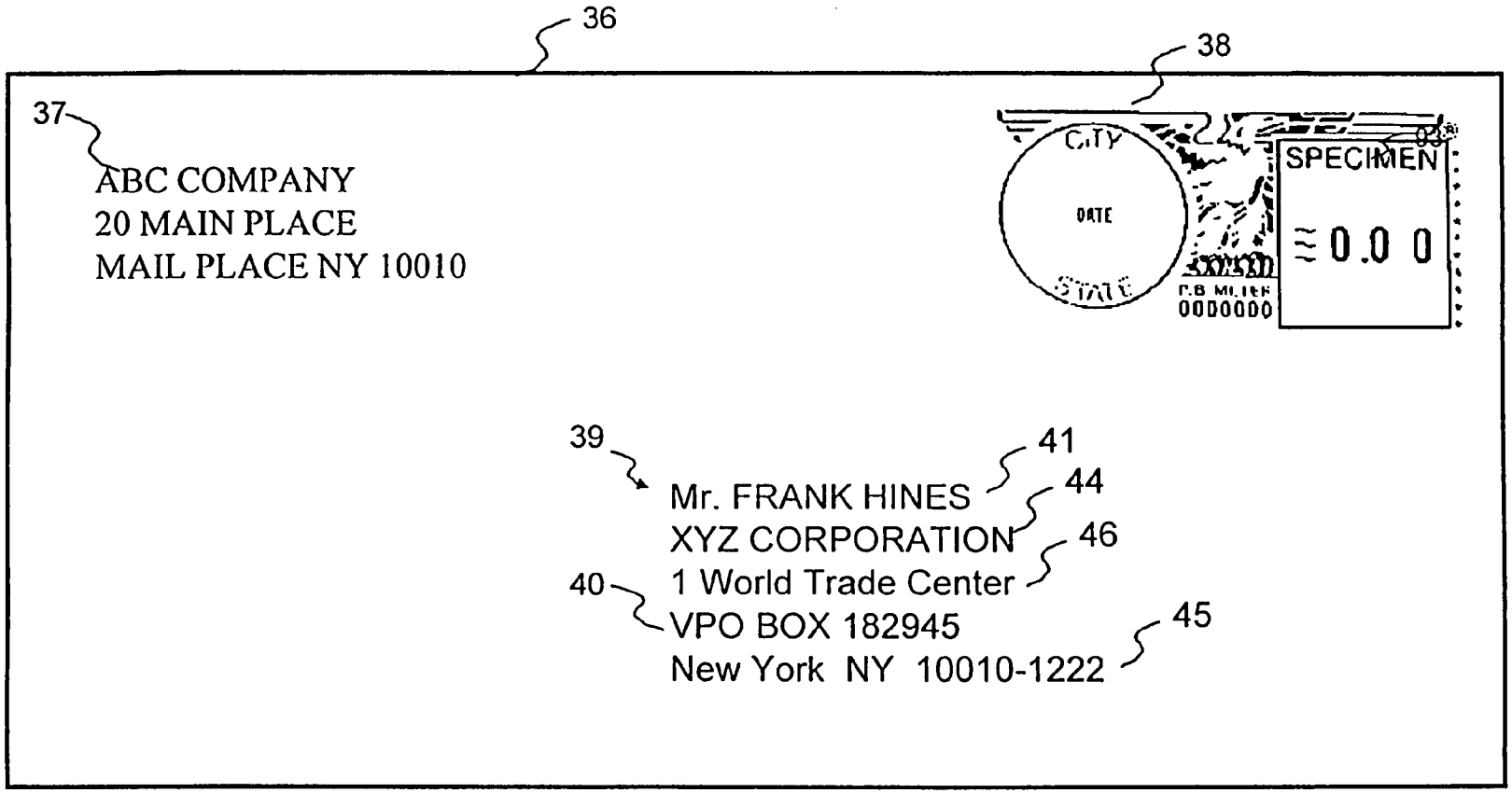
FIG. 3C is a drawing of a mail piece addressed to a virtual post office (VPO) box with some actual address information and some vanity address information.

FIG. 3C is a drawing of a mail piece addressed to a virtual post office (VPO) box with some actual address information and some vanity address information. Mail piece 36 has a sender address field 37 and material 38 that indicates the payment of the postage for mail piece 36. Material 38 may be a postal indicia, postal permit or one or more stamps. The recipient address field 39 will include the designation 40 for a virtual post office box and the box number i.e., VPO etc. and the number of the virtual post office box, the person or entity 41 to whom mail piece 36 is sent, the business entity 44 that the person represents, the city, state and zip code 45 of the business entity and a vanity location 46. The city, state and zip code 45 may be the actual city, state and zip code that mail piece 36 is going to be delivered to and location 46 may be a place within zip code 45 that is used for vanity purposes.

Figure 3D:
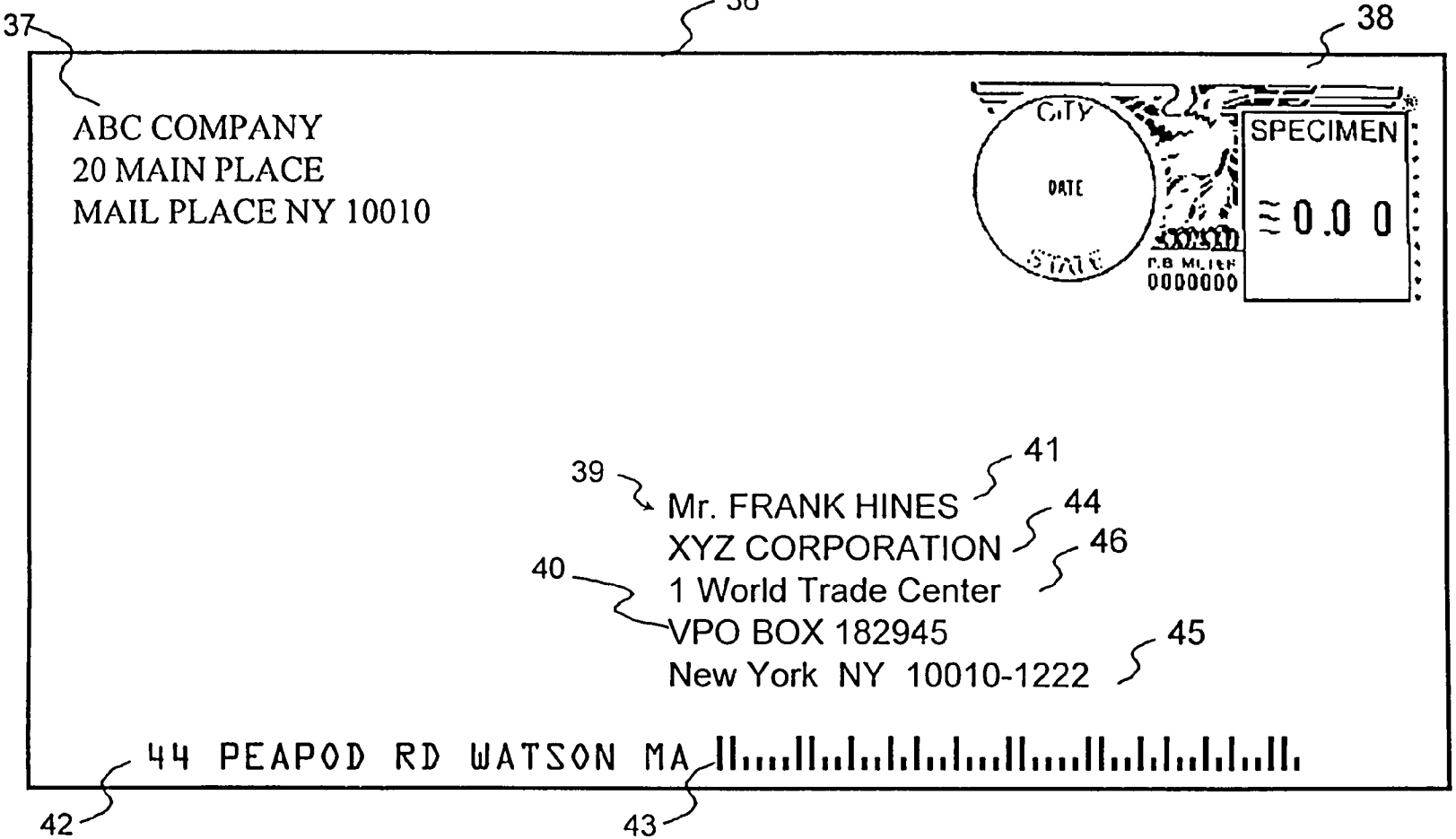
FIG. 3D is a drawing of a mail piece addressed to a virtual post office (VPO) box with some actual address information and some vanity address information which the post has indicated the actual delivery address.

FIG. 3D is a drawing of a mail piece addressed to a virtual post office (VPO) box with some actual address information and some vanity address information upon which the post has indicated the actual delivery address 42. Mail piece 36 has a sender address field 37 and material 38 that indicates the payment of the postage for mail piece 36. Material 38 may be a postal indicia, postal permit or one or more stamps. The recipient address field 39 will include the designation 40 for a virtual post office box and the box number i.e., VPO etc. and the number of the virtual post office box, the person or entity 41 to whom mail piece 36 is sent, the business entity 44 that the person represents, the city, state and zip code 45 of the business entity and a vanity location 46. The city, state and zip code 45 may be the actual city, state and zip code that mail piece 36 is going to be delivered to and location 46 may be a place within zip code 45 that is used for vanity purposes. The post will print the actual delivery address 42 that the lessee of the virtual post office box wants mail piece 36 delivery to. The post will also print a posnet bar code 43 on the face of mail piece 36. Bar code 36 represents delivery address 42 in a coded form.

FIG. 4 is a drawing showing how one may obtain a virtual post office box and how one may change the address to which the mail having a virtual post office box will be delivered. Mailers 50 may communicate their intentions regarding their virtual post office box via telephone, personal computer, facsimile, or by actually going to a post office.

If a mailer communicated with the post via telephone, the mailer may communicate with voice response unit (VRU) 51. A plurality of recorded messages are stored in voice response unit 51. Data center computer 54 determines which recorded message would be transmitted to the mailer that is using a telephone. The telephone caller responds to the recorded message by pressing one or more of the buttons on keypad of the telephone. The messages are transmitted to VRU 51 from the telephone in the form of dual tone modulated frequency (DTMF) tones. The DTMF tone corresponding to a # button on keypad of the telephone will signify the end of a message. VRU 51 converts the DTMF tones into numbers that computer 54 can read. Computer 54 will then inform VRU 51 the appropriate recorded message or response. In the foregoing manner, the telephone caller VRU 51 and computer 54 may obtain enough information from the telephone caller to complete the virtual post office receipt described in the description of FIG. 5 and/or forward mail piece 36 to a address different than the address that was originally supplied to the post, i.e., a location where someone is going on their vacation.

If a mailer communicated with the post via a personal computer, the mailer may communicate with post office modem 52, which is coupled to data center computer 54. Computer 54 and the mailer's personal computer may have various protocols that are known in the art that must be satisfied before the mailer's computer can exchange virtual post office box information with computer 54. After the protocols have been satisfied computer 54 may obtain enough information from the mailer's computer to complete the virtual post office receipt described in the description of FIG. 5 and/or forward mail piece 36 to a address different than the address that was originally supplied to the post, i.e., a location where someone is going on their vacation.

If a mailer communicated with the post via a facsimile, the mailer may communicate with post office facsimile 53, which is coupled to data center computer 54. The facsimile sent by the mailer may correspond to the virtual post office receipt described in the description of FIG. 5.

Figure 5:
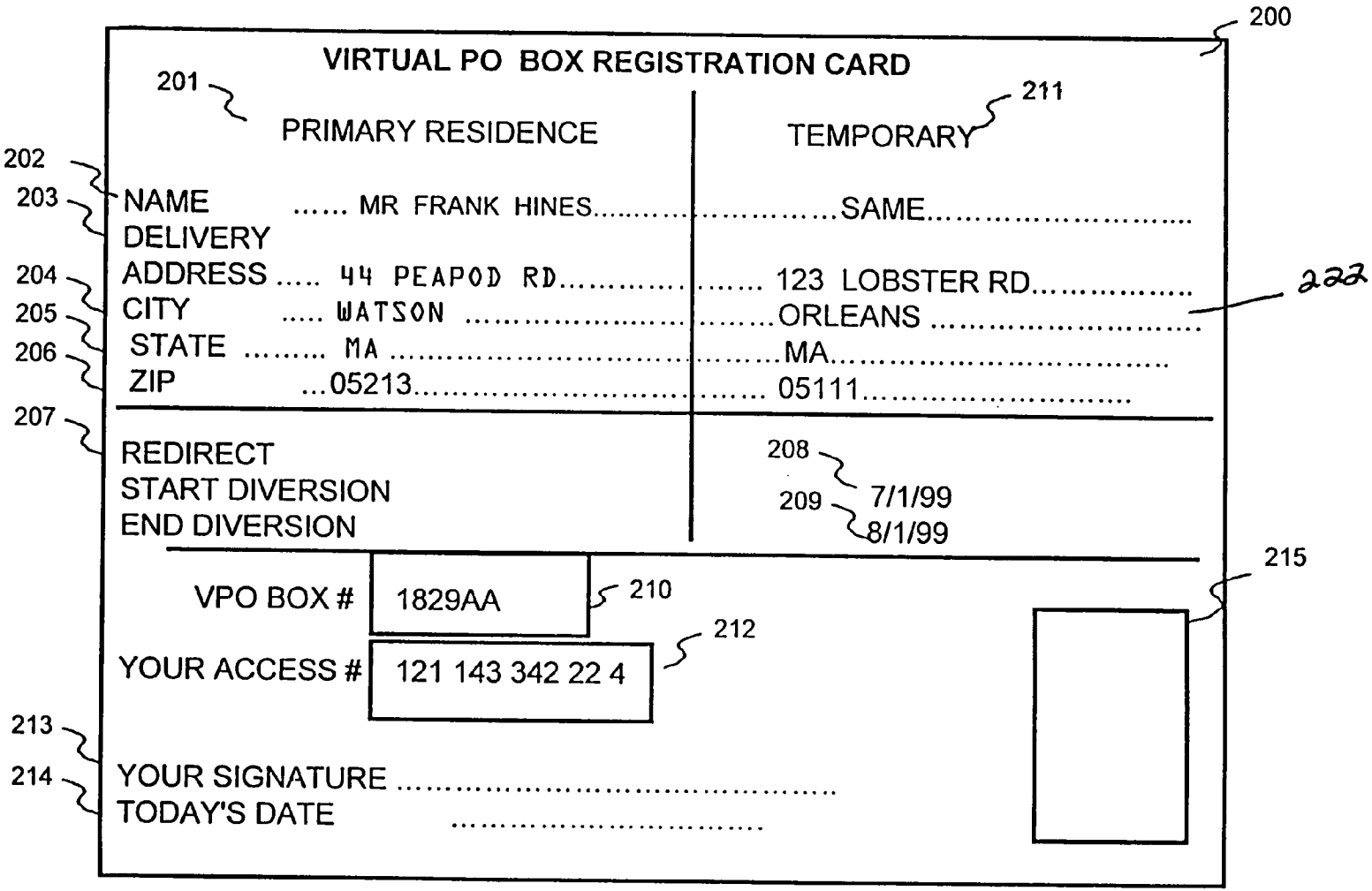
FIG. 5 is a drawing of a virtual post office box registration card.

A mailer may also communicate by physically going to a clerk's desk 55 at data entry site 55 or mail information contained in FIG. 5 to site 55. The mailer would then give the postal clerk any necessary information that is required to obtain a virtual post office box and/or forward mail piece 36 to a address different than the address that was originally supplied to the post, i.e., a location where someone is going on their vacation.

National name and address database 65 is coupled to national postal code database 66 and validate user request process 62. Database 65 includes the names and addresses of people and entities residing in the United States. National postal code database 66 includes every valid postal deliverable address in the United States. Change request database 67 is coupled to virtual post office box name/address relational database 68. Database 65 is used as a reference for database 68 and changes to database 68 are received from change request database 67. Postal code updates computer 70 will transmit new zip codes to national code database 68 via modem 60, computer 54, process 62 and process 69. Name or address updates computer 71 will transmit new name or address changes to database 65 via modem 60, computer 54, process 62 and process 69.

Computer 54 will obtain mail forwarding information for mail piece 36 by receiving the information from data base 68 when a proper request is received from validate user request process 62 and process 69 metered the above request. Data base 68 will indicate the current address that the lessee of the virtual post office wants their mail delivered. Computer 54 will transmit the current address that the lessee of the virtual post office wants their mail delivered for the requested VPO Box number to modem 56. The current address will be sent in the form of a postnet bar code as well as in human readable text. Modem 56 will transmit the address to sorters 12, 13 and 14 and re-coder 18 (FIG. 1) and sorters 24, 25, 26 and 28 and re-coder 33 (FIG. 2).

Validated user request process 62 is coupled to computer 54. Process 62 determines whether or not the mailer gave the post the correct access number 212 (described in the description of FIG. 5) so that the post will be satisfied that it is communicating with the actual lessee of the virtual post office box. Process 62 also determines the forwarding address for the VPO Box number read by the post office.

FIG. 5 is a drawing of a virtual post office box registration card 200. Card 200 may be used for registering a virtual post office box and as a receipt for changing the primary delivery address for the virtual post office box. Card 200 indicates: the primary residence 201 of the person or entity who is registering for a virtual post office box in space 202; their street delivery address in space 203; their delivery city in space 204; their delivery state in space 205; and their delivery zip code in space 206. The date in which the virtual post office box service will begin and end is shown in space 207. The assigned VPO Box is shown in space 210 and the access code is shown in space 212. Access code 212 is used when communicating any changes or modifications to card 200 i.e., changing the primary delivery address to a temporary delivery address 222. Access code 212 may be an encrypted number.

The date in which the lessee of the virtual post office box wants mail to be delivered to the temporary delivery address 222 is shown in space 208 and the date which the lessee of the virtual post office box no longer wants mail to be delivered to the temporary delivery address 222 is shown in space 209. The signature of the person who is registering the virtual post office box or the authorized representative of the entity who is registering the virtual post office box will be placed in space 213. The date the signature was signed in space 213 is indicated in space 214. A biometrics 215 of the person whose signature appears in space 213 may also be placed on card 200. Biometrics 215 may be: a picture of the person signing in space 213; the person's fingerprint; etc.

The lessee of the virtual post office box may modify or change any information contained in card 200 by going to data center 75 (FIG. 4) and showing card 200 to the clerk; faxing the information contained in card 200 to data center 75; telephoning data center 75 and giving a voice response unit 51 (FIG. 4) information contained in card 200; sending the information contained in card 200 to data center 75 via a computer. Biometrics 215 may be used by data center 75 to further authenticate the person modifying or changing any information contained in card 200.

Figure 6:
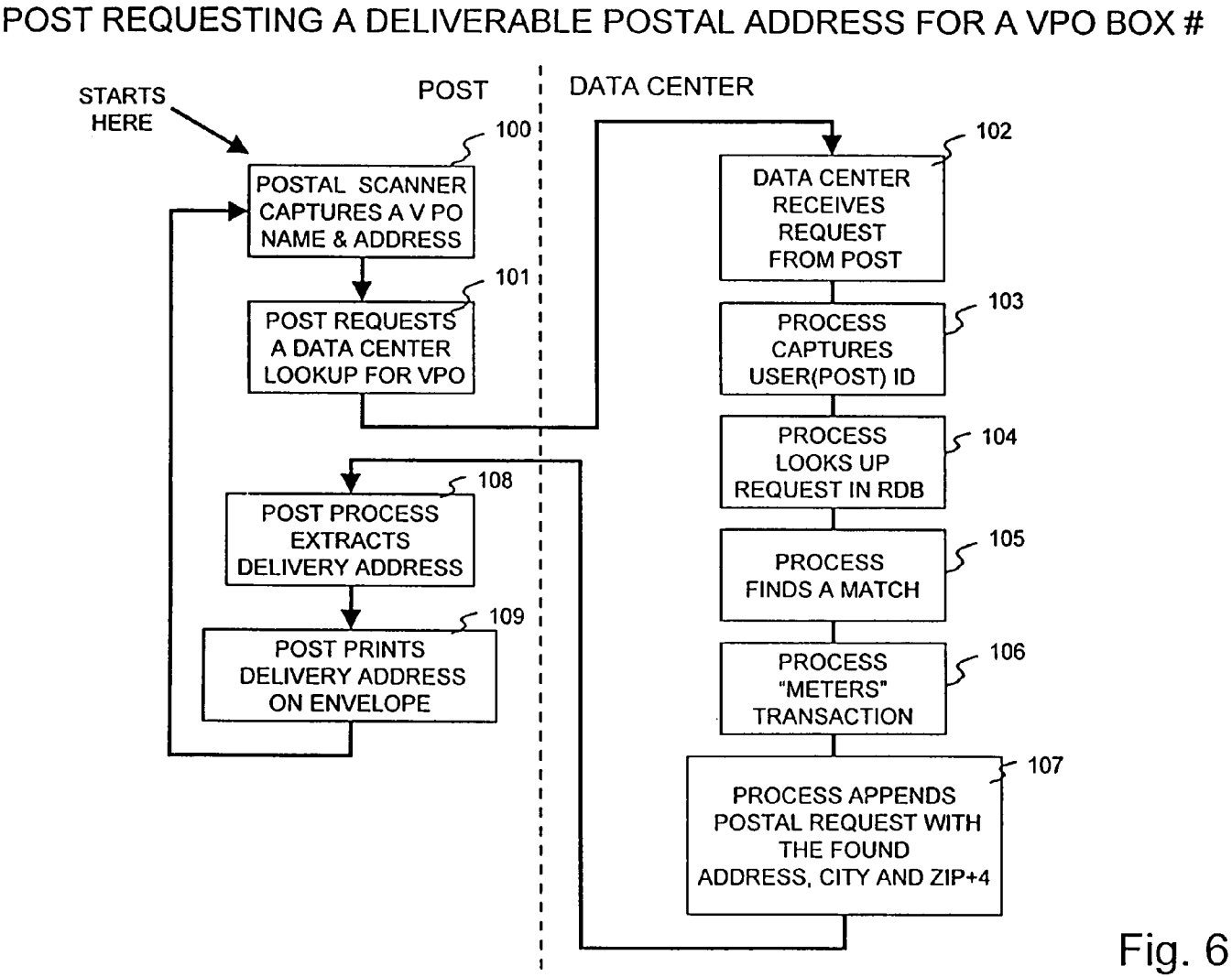
FIG. 6 is a drawing of a flow chart showing a request by the post for a postal address for a virtual post office box.

FIG. 6 is a drawing of a flow chart showing a request by the post for a postal address for a virtual post office box. The program begins in block 100 where a postal scanner (FIG. 1, FIG. 2) captures a virtual post office box number from a mail piece 36 (FIG. 3A, FIG. 3B). Then the program goes to block 101 where the post requests data center 75 to lookup the current requested delivery address for the virtual post office box number scanned. Now the program goes to block 102 where data center 75 receives a lookup request from the post. Next in block 103 data center 75 captures the identity of the post office that scanned the mail piece.

In block 104, the process searches the virtual post office boxes in database 68 to find the current postal requested delivery address for the VPO Box number captured. In block 105 the process determines whether or not a requested delivery address matches the VPO Box number captured. Then the program goes to block 106 where access metering and billing process 69 meters the above transaction so that the post or mailer may be charged for the services provided. At this point in block 107 the process appends the aforementioned request with the forwarding delivery address that matches the VPO Box number captured. The looked up address is supplied in a postnet bar code format as well as in human readable text. Next in block 108 the post extracts the looked up address. Then in block 109 the post's scanners (FIG. 1 and FIG. 2) prints the looked up address on a mail piece in a postnet bar code format as well as in human readable text. At this point the program goes back to the input of block 100.

Figure 7:
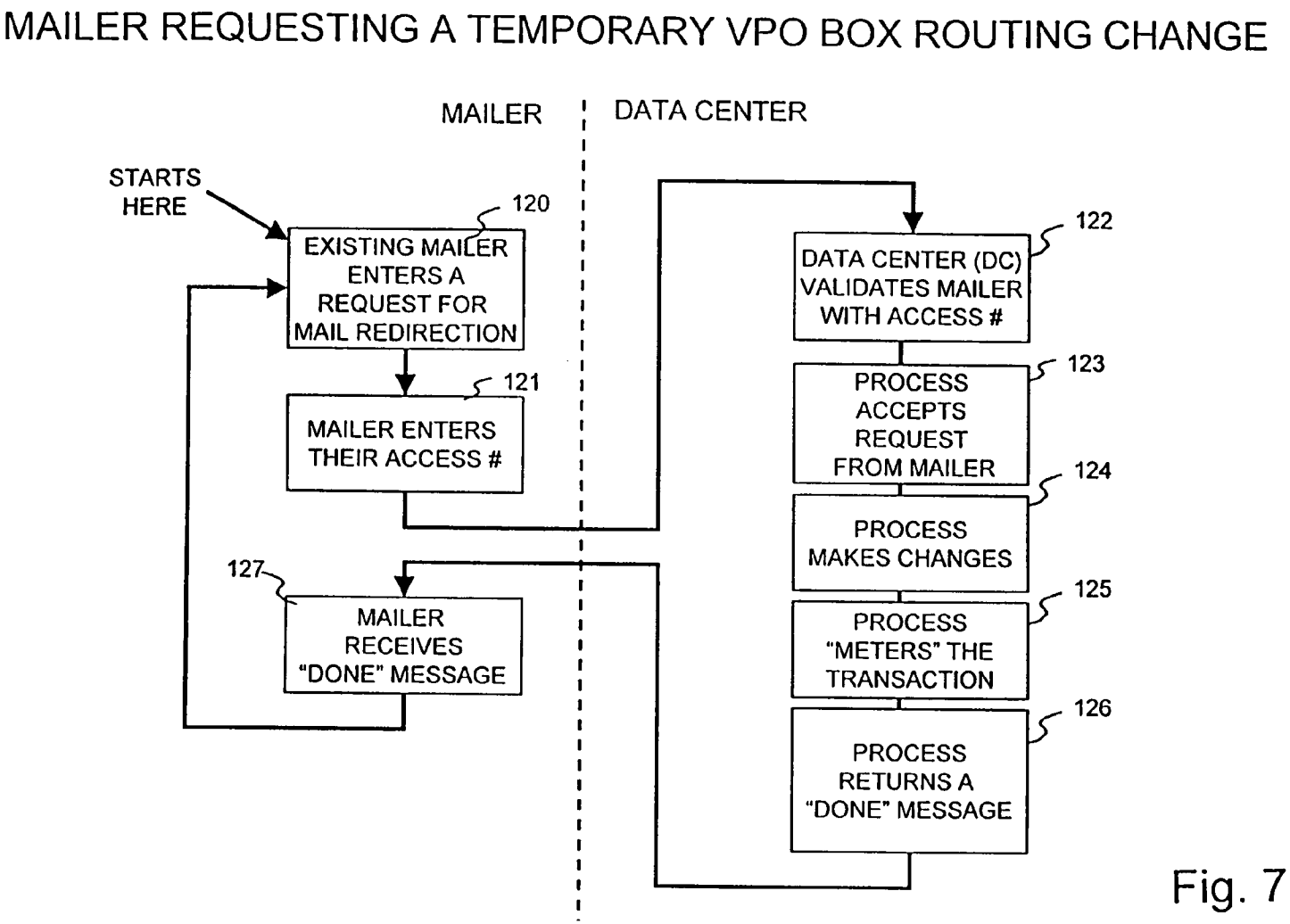
FIG. 7 is a drawing of a flow chart showing a request by a mailer requesting a virtual post office box routing change.

FIG. 7 is a drawing of a flow chart showing a request by a mailer requesting a virtual post office box routing change. The program begins in block 120 where a mailer enters a request to have the delivery address for their virtual post office box number changed to a different delivery address for a fixed period of time or permanently. Then the program goes to block 121 where the mailer enters their access number 212. Access number 212 may be an encrypted number. Now the program goes to block 122 where data center computer 54 validates the mailer by determining whether or not the mailer has the correct access number. Next, in block 123, computer 54 accepts the request from the mailer. In block 124 computer 54 makes the address change requested by the mailer. The requested changes are stored in databases 67 and 68. In block 125 access metering and billing process 69 meters the above transaction so that the post or mailer may be charged for the services provided. Then the program goes to block 126, where process 69 indicates the process was completed. Now the program goes to block 127 where the mailer receives a message that the requested address change has been completed. At this point the program goes back to the input of block 120.

Figure 8:
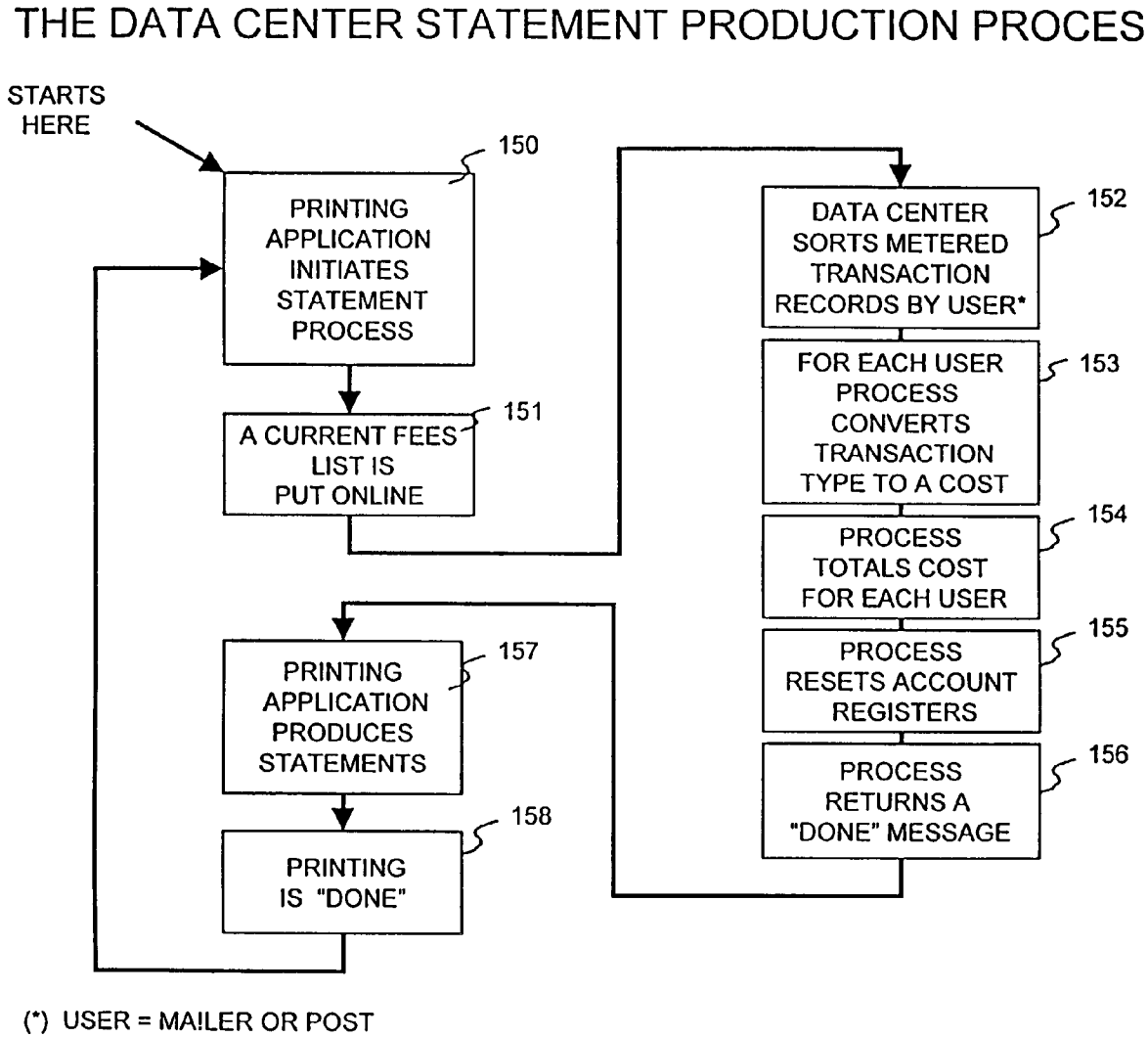
FIG. 8 is a drawing of a flow chart showing the generation of a statement by access metering and billing process 69.

FIG. 8 is a drawing of a flow chart showing the generation of a statement by access metering and billing process 69. The program begins in block 150 where a statement initiation process is begun. Then the program goes to block 151 where the current fees for the requested services are transmitted. Now the program goes to block 152 where data center computer 54 sorts the transactions metered by process 69 and records the transactions by specific mailers and the post. Next in block 153 computer 54 converts each transaction type to a cost. In block 154 computer 54 totals the cost for each specified mailer and the post. The program goes to block 155 to reset the account registers. In block 156 the program produces a done message upon completion of the task. Next in block 157 a printer (not shown) at data center 75 produces statements for the provided services. Then the program goes to block 158 to indicate that the printed statements are completed. At this point the program goes back to the input of block 150.

The above specification describes a new and improved system and method for enabling the post to deliver mail addressed to a recipient's virtual post office box to be delivered directly to the recipient. It is realized that the above description may indicate to those skilled in the art additional ways in which the principles of this invention may be used without departing from the spirit. It is, therefore, intended that this invention be limited only by the scope of the appended claims.

What is claimed is:

1. A method using a computer for forwarding mail by a post that is addressed to a recipient at a virtual post office box to be delivered directly to a recipient without the recipient going to the post, said method comprises the steps of:

receiving by the computer recipient's name and recipient's desired delivery address;

assigning a virtual post office box identification for individual recipients;

relating by the computer recipient's virtual post office box with the desired delivery address of the recipients;

delivering to recipients their assigned virtual post office box's identification;

placing virtual post office box identification on physical mail;

reading mail to capture virtual post office box identification, when present;

determining recipient's desired delivery address from virtual post office box identification and recipient's name;

determining in one or more data bases that recipient's name is listed with recipient's desired delivery address and is the address to which the owner of the virtual post office box wants the mail forwarded, wherein the forwarding information is sent by telephone, physical mail, or facsimile;

placing recipient's desired delivery address on mail in coded form and human readable form; and delivering mail to the desired delivery address of the recipients.

2. The method claimed in claim 1, further including the step of:

changing recipient's desired delivery address in accordance with recipient's instructions.

3. The method claimed in claim 2, wherein in the changing step:

recipient specifies the time period in which mail is going to be delivered to the desired delivery address.

4. The method claimed in claim 1, further including the step of:

billing for the number of times recipient's changed their desired delivery address.

5. The method claimed in claim 1, further including the step of:

metering the number of times recipient's desired delivery address was determined.

6. The method claimed in claim 5, further including the step of:

billing for the number of times recipient's desired delivery address was determined.

7. The method claimed in claim 1, wherein recipient's virtual post office box is represented in alphanumeric characters.

8. The method claimed in claim 1, further including the steps of:

assigning access codes to recipients that are related to recipient's virtual post office box;

delivering access codes to recipients;

receiving recipient's name, access code and recipient's intention to change their delivery address;

changing recipient's delivery address upon conformation of recipient's name and access code.

9. The method claimed in claim 8, further including in the changing step, the steps of:

confirming recipient's virtual post office box.

10. The method claimed in claim 8, wherein in the changing step: recipient specifies the time period in which mail is going to be delivered to the changed delivery address.

11. The method claimed in claim 8, further including in the changing step, the steps of:

assigning a biometrics to recipients;

delivering the biometrics to recipients;

receiving recipient's biometrics and recipient's intention to change their delivery address;

changing recipient's delivery address upon conformation of recipient's biometrics.

12. The method claimed in claim 8, wherein recipient's name, access code and recipient's intention to change their delivery address will be received by telephone.

13. The method claimed in claim 8, wherein recipient's name, access code and recipient's intention to change their delivery address will be received by facsimile.

14. The method claimed in claim 8, wherein recipient's name, access code and recipient's intention to change their delivery address will be received by computer.

15. The method claimed in claim 8, wherein recipient's name, access code and recipient's intention to change their delivery address will be received in person.

16. The method claimed in claim 8, wherein recipient's name, access code and recipient's intention to change their delivery address will be received by mail.

17. The method claimed in claim 8, wherein recipient's access code is encrypted.

18. The method claimed in claim 1, wherein one of the data bases is the National Name and Address Data Base.

* * * * *